United States Patent [19]

MacDonald

[11] Patent Number: 4,541,212

[45] Date of Patent: Sep. 17, 1985

[54] ADJUSTABLE WIDTH FRAME MEMBER FOR WALL OPENINGS

[76] Inventor: Donald MacDonald, 11615 NE. 116th St., Kirkland, Wash. 98033

[21] Appl. No.: 607,508

[22] Filed: May 7, 1984

Related U.S. Application Data

[63] Continuation-in-part of Ser. No. 444,997, Nov. 29, 1982, abandoned.

[51] Int. Cl.[4] ..... E04C 3/38; E06B 1/04

[52] U.S. Cl. ..... 52/217; 49/505; 52/716; 52/730

[58] Field of Search ..... 52/210–212, 52/217, 716–718, 461, 468, 280–282, 730, 242; 49/505

[56] References Cited

U.S. PATENT DOCUMENTS

| | | | |
|---|---|---|---|
| 1,197,031 | 9/1916 | Kelly | 49/505 |
| 1,772,417 | 8/1930 | Ellinwood | 52/468 |
| 1,779,346 | 10/1930 | Trachte | 52/772 |
| 2,185,650 | 1/1940 | Shipway et al. | 49/505 |
| 2,651,814 | 9/1953 | Lester | 49/380 |
| 2,662,252 | 12/1953 | Styles | 52/282 |
| 3,103,710 | 9/1963 | Fredericksen | 52/211 |
| 3,553,891 | 1/1971 | Casebolt et al. | 49/505 |
| 3,707,057 | 12/1972 | Frydenberg | 49/505 |
| 3,800,488 | 4/1974 | Swanson | 49/505 |
| 3,981,103 | 9/1976 | McAllister | 49/505 |

FOREIGN PATENT DOCUMENTS

| | | | |
|---|---|---|---|
| 531202 | 9/1954 | Belgium | 52/276 |
| 727846 | 2/1966 | Canada | 52/461 |
| 202814 | 5/1939 | Switzerland | 52/716 |

*Primary Examiner*—James L. Ridgill, Jr.

*Attorney, Agent, or Firm*—Ford E. Smith; David L. Garrison

[57] ABSTRACT

This invention is an adjustable frame member or jamb for a wall opening and a method for making it. It consists of two side-by-side jamb members, a spring and a stop. The stop is attached to one jamb member in an overhanging or step-like relationship. The spring is inserted into the back of this member so that an elongated portion defines a slot with the overhanging portion of the stop. Narrow kerfs are appropriately let into the back of the jamb and the door stop for anchoring the arm portions of the spring. The second jamb member is slid into the slot defined by the stop and spring, where it is firmly gripped by the spring. By forming one mounting point for the spring in the back of the stop, a short lever arm is maintained to better resist any prying or dislodging forces applied against the spring caused by the other jamb member. The artical can conveniently be made by first attaching one edge of the stop to a jamb of the narrowest width expected in use. The jamb is severed into two pieces and the kerfs are simultaneously cut. An inlet zone into the jamb members in the area of the spring enables the assembly to have a flat back for rigid mounting against a framing stud.

8 Claims, 6 Drawing Figures

Fig. 1.
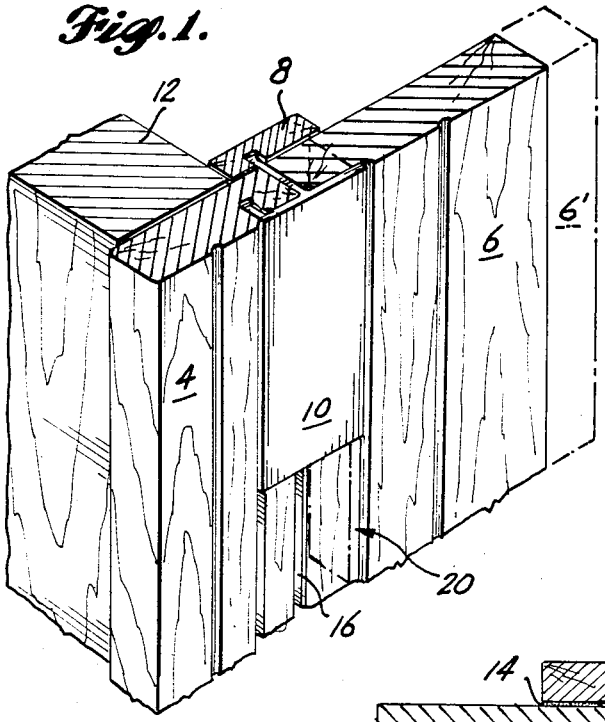
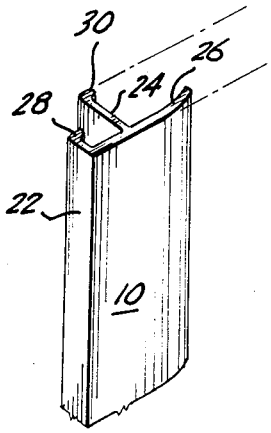
Fig. 4.
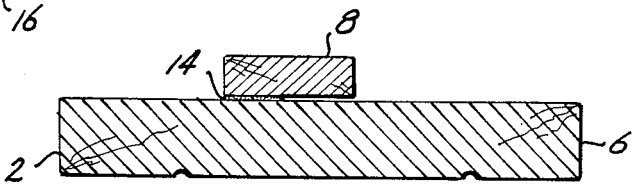
Fig. 2.
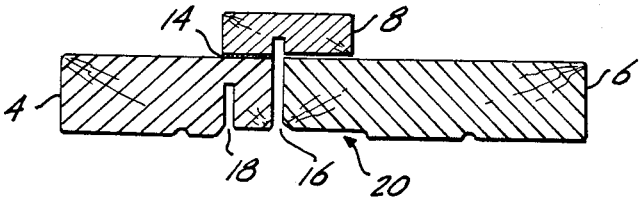
Fig. 3.
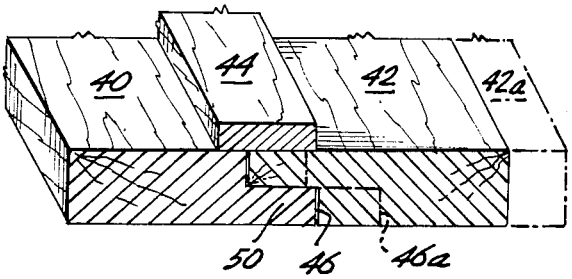
Fig. 5.
(PRIOR ART)

ADJUSTABLE WIDTH FRAME MEMBER FOR WALL OPENINGS

RELATED APPLICATION

This application is a continuation-in-part of the copending application, Ser. No. 444,997, filed Nov. 29, 1982 and containing additional matter, now abandoned.

BACKGROUND OF THE INVENTION

The present invention is a member for use in a door or window frame which is readily adjustable for installation in walls of varying thicknesses.

In common building construction door and window openings are usually rough framed with wooden studs. The studs are later covered on both sides by plaster, wall panels or more often by a gypsum-filled wallboard known in the building trade as "sheetrock". Studs average about 88.9 mm (3.5 in width). However, this dimension is not consistent between various parts of the country, or even from sawmill to sawmill. Gypsum board is sold in various thicknesses. Local building codes usually dictate the thicknesses that will be required at any given location in a building. The most common thickness is 12.7 mm (0.5 in), but a 15.9 mm (0.625 in) grade is almost as common. Not infrequently a wall will have one thickness on one face and a different thickness on the other face.

Varying wall thicknesses pose expensive problems. Door and window frames are almost invariably made of clear, knot-free lumber. Due to the scarcity of large trees from which clear lumber is cut, such lumber has become extremely expensive. Waste must be minimized. If wall openings were always of uniform thickness, suitable door and window frames could be cut in the sawmills. As it is, most carpenters must now start with wider boards and labor intensively to trim these to the desired finished width. This incurs a waste of both labor and of materials.

Various people in the past have addressed the problem of making frames which are adjustable in width for wall openings. Kelly, in U.S. Pat. No. 1,197,031, shows a two-part door jamb. Steps are milled in one part of this jamb and in the stop. The jamb portions can be moved relative to each other to accomodate wider or narrower openings, with any gap between them being covered by the stop. Shipway, in U.S. Pat. No. 2,185,650, shows a similar construction which is simpler in principle but, utlimately, is more complex in practice. The gap between a two-part jamb is covered with a stop member. The jamb portions are nailed to mounting brackets after they are adjusted as to width and the brackets are thereafter nailed to the studs defining the wall opening. Lester, Jr., in U.S. Pat. No. 2,651,814, shows a complex four-part door frame. The jamb is divided into two members and each member has a longitudinal slot along its interior edge. The stop has a T-shaped base which fits in the slots along the edges of the jamb. After the frame is installed, a second part of the stop is nailed adjacent the first in order to cover any gap created by adjustment during installation. Frydenburg, U.S. Pat. No. 3,707,057, shows a construction similar to that in the Lester patent. However, the stop is a plastic molding, similar to a hose, which can compress or expand as the jamb members are adjusted. Casebolt, et al., U.S. Pat. No. 3,553,891, shows a very complex adjustable jamb.

Adjustable jambs shown by Swanson, U.S. Pat. No. 3,800,488, and McAllister, U.S. Pat. No. 3,981,103, have somewhat more similarity to the one of the present invention. Swanson's frame is a two-piece foamed plastic molding. The stop is integral with one jamb piece and has a slot molded in the end to accomodate the other jamb piece. Because of the particular slot construction employed, this frame has a very small bearing area against the studs which define the door opening. McAllister's device is a complex integral frame and moldings. A vinyl covered wooden member is cut with a series of V-shaped kerfs which go all the way through the wood, but do not cut the vinyl skin. This is folded at the kerfs to form a two-piece structure of adjustable width. One jamb portion is held in place by a retainer piece nailed to the inside of the other jamb. This cooperates with the stop to form a slot in which the first jamb piece is fitted.

The construction shown in U.S. Pat. Nos. 1,197,031 and 3,981,103 both waste considerable portions of the wood. Because of their relative complexity it is doubtful whether any of the previously known adjustable frames really represent an economy over traditional methods of construction. The present invention has addressed that problem and is a major step forward.

SUMMARY OF THE INVENTION

The present invention is an adjustable wood jamb member for door, window or similar openings in building walls. The invention further comprises a method for making an adjustable jamb as well as the assembled frame element comprising first and second jamb members, a stop member and spring means which unites the structure. The jamb members have front and rear surfaces each and inner surfaces and inner and outer edges. Spring means has an elongated leg portion and at least one transverse arm which serves to anchor it into the jamb. The stop member is permanently united to the front surface of the first jamb member so as to overhang the inner edge in step fashion and form one side of a slot. The spring means is anchored by its transverse arm or arms into the rear surface of the first jamb member. Preferably the spring is generally F-shaped with a first transverse arm anchored in a kerf cut into the rear surface of the first jamb member and a second transverse arm held in a similar kerf cut into the back of the stop. The leg portion of the spring means is oriented generally parallel to the overhanging part of the stop so as to define a slot. The inner edge of the second jamb member is disposed in this slot so that it is slideable toward or away from the first jamb member to adjust the width. The second jamb member is gripped against the stop by the leg portion of the spring, which is preferably bowed toward the stop to provide a biasing force. Usually the two jamb members are supplied in the most compact assembly to the point of installation.

The preferred frame element can be most conveniently manufactured in the following manner. One edge of the stop is attached in its usual position on a unitary jamb which is as wide as the narrowest opening likely to be encountered. A first kerf is made in a back of the jamb which severs the member into two pieces. This kerf is made over the stop, adjacent to the attached edge and may go part way into the stop to provide a second spring-anchoring location. The stop remains attached to the first member to give the step contruction described previously.

A second kerf, parallel to and adjacent the first kerf, is let into the rear surface of the first jamb member. This second kerf passes only part way through the jamb member. The second kerf, and the first if it was made into the stop, provide channels into which spring means of several cross-section shapes can be anchored. The portion of the unitary jamb which was severed when the first kerf was made can now be inserted into the slot defined by the stop and a part of the spring. While the foregoing description might suggest that the two kerfs were made sequentially, under normal circumstances they would be made at the same time.

In the preferred version of the invention, a shallow area will be inlet into the back surface of the two jamb portions so that the spring does not protrude above the rear surfaces of the reassembled first and second jamb members. This allows the frame to be mounted solidly against a stud wall that roughly frames an opening.

In an alternative form of the invention the generally F-shaped spring means has a pair of transverse arms that are anchored into the rear of the first jamb member by means of a pair of parallel kerfs provided therein.

It is an object of this invention to provide a simple and economical adjustable jamb to frame a wall opening.

It is another object to provide a frame for wall openings which can be readily adjusted to the desired width at the place and time of use.

These and other objects will become readily apparent to those skilled in the art upon reading the following detailed description taken in conjunction with the drawings.

BRIEF DESCRIPTION OF THE DRAWINGS

FIG. 1 is a fragmentary perspective view, partially in section, of an assembled door jamb.

FIG. 2 is a cross section showing the first step of manufacture of the door jamb.

FIG. 3 is a similar cross section showing the second manufacturing step.

FIG. 4 is a perspective view of the preferred type of spring which unites two jamb sections.

FIG. 5 is a prior art adjustable door jamb known to the present inventor.

DETAILED DESCRIPTION OF THE PREFERRED EMBODIMENT

Figure 6:
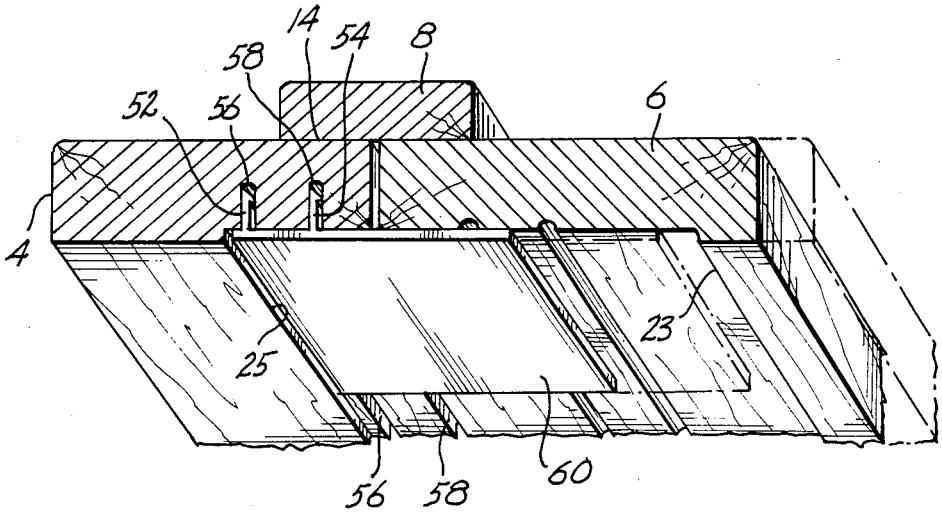
FIG. 6 is a perspective view of an alternative form of the invention.

Reference to FIGS. 1 thru 4 will readily show one skilled in the art how the present door frame member is constructed and a preferred method for its manufacture. It should be understood that while this description is in the context of a door or window frame, its usefulness is not limited to these applications. The variable width jamb, generally shown at 1, consists of a first jamb member 4 and second jamb member 6 in a edge-to-edge relationship. A stop 8 is permanently attached to the inside edge of the front surface of jamb member 4. This can conveniently be nailed, stapled, or preferrably adhesively bonded at 14. A spring member 10 is inserted into conveniently located and sized parallel kerfs cut in the back of the first jamb member 4 and into stop 8. Spring 10 is inserted into these kerfs. The elongated leg of this generally F-shaped spring member defines one side or wall of a slot while the unattached edge of the door stop forms the other side or wall of the slot. The second jamb member 6 is slipped into this slot where it can be moved in or out, as indicated by the dotted portion 6', to precisely fit the width of the wall opening. While the F-shaped spring is preferred, an L-shaped or T-shaped spring would also be suitable. When an L-shaped spring configuration is used there is no need for the one kerf to enter the back of the stop 8. FIG. 1 indicates how a door 12 would bear against the stop.

The adjustable jamb member is most conveniently made from a single piece of lumber 2 (shown in FIG. 2) which is as wide as the minimum thickness of an anticipated wall opening. Adhesive is laid as a bead along one edge of stop 8. The stop is then marginally bonded in the normal location as shown at 14. A combination of saws and a milling head then cut the kerfs 16 and 18 in the back of board 2 and simultaneously there is cut inlet area 20 to receive a portion of the spring so that it does not protrude beyond the rear surface of the assembly as may be seen in FIG. 1. The preferred type of spring, as illustrated in FIG. 4, is generally F-shaped. It usually has a shorter arm 22 and longer arm 24 disposed approximately at right angles to the bridging portion 26. The arm portions each have an anchoring means 28 and 30 at their distal ends. These anchoring means cooperate in the kerfs 16 and 18 to tightly hold the spring in the assembly. By mounting the spring member so that the longer arm 24 bears against the inside edge of the first jamb member and is anchored into the back of the stop, a very short lever arm is maintained to resist prying or spreading forces caused by the insertion of second jamb member 6 into the slot between the stop 8 and the spring means. Bridge portion 26 of the spring means is conveniently bowed inward toward the stop 8 to create a biasing force which holds the second jamb member 6 tightly in place. Bridge portion 26 is disposed in the inlet area 20 which may be wider than portion 26 or the same width as shown in FIG. 1. When an installer must provide a jamb for a thinner than usual wall, he may simply slice off the inner edge surface of the jamb portion 6. A construction that is considered to be fully equivalent involves the use of an F-shaped spring with both transverse arms 24, 28 anchored in kerfs let into the rear surface of the first jamb member.

Spring 10 may either extend the full length of the structure, or it may be present as shown as a series of shorter elements spaced along the length of the frame. The spring is practically formed as an extrusion, either of aluminum or of a plastic material such as polyvinyl chloride. In the latter case, it may be readily cut by ordinary carpenters' hand tools.

FIG. 5 shows an adjustable prior art frame member known to the present inventor. It consists of a first jamb member 40 and second jamb member 42, with a stop 44. Corresponding or interfitting steps are cut into the inside edge of each jamb member along a line 46. The construction is adjusted as to width by sliding the tongue member 48 back and forth in the slot defined between stop 44 and step 50 of the left hand jamb member. While this construction is relatively simple, it will be seen to waste the equivalent of a strip of wood at least equal to the width of the steps and as thick as the jamb members.

FIG. 6 shows an alternative form of the invention in which first jamb member 4 is provided with a parallel pair of kerfs 56 and 58 in its rear surface. The spring 60, also F-shaped, has a pair of transverse arms 52 and 54 which are inserted into kerfs 56 and 58 respectively to anchor spring 60 in place. The leg portion 62 of the spring means is oriented generally parallel to the overhanging stop member 8 to form therebetween the slot to receive the other jamb member 6. Inlet areas 23 and 25 on the back sides of the jamb members 6 and 4 respectively receive portions of spring means 60 so that the rear of the assembly is substantially flush. The doted lines in FIG. 6 illustrate how jamb member 6 may be moved outward to provide a greater overall width to the jamb assembly. Grooves 64 are supplied as cutting guide lines useful in narrowing the jamb by longitudinal ripping of member 6.

Having thus described the best modes of the invention, it will be apparent to those skilled in the art that many minor variations could be made without departing from the spirit of the present invention. The invention is thus considered to be limited as to scope only by the following claims, suitably accorded a breadth of equivalency proportionate to the contribution made to the art.

What is claimed:

1. An adjustable width frame member for wall openings which comprises:

(a) first and second jamb members, each member having front and rear surfaces and inner and outer edges;

(b) a stop member; and (c) a generally F-shaped spring means having an elongated leg portion and two transverse arms, the stop member being permanently united to the front surface of the first jamb member so as to overhang the inner edge and form one side of a slot, the spring means being anchored by its first transverse arm into the rear surface of the first jamb member and by its second transverse arm into the stop member, the leg portion of the spring means being oriented generally parallel to the overhanging stop member to form the other side of the slot, the inner edge of the second jamb member being disposed in the slot so as to be slideable toward or away from the first jamb member and being gripped against the stop by the leg portion of the spring means so as to form a frame adaptable for installation on walls of varying thickness.

2. The frame member of claim 1 in which the lower transverse arm of the spring means bears against the inner edge of the first jamb member.

3. The frame member of claim 1 in which the rear surfaces of the jamb members are inlet in the area of the spring means so that the spring is flush with the rear surfaces.

4. The frame member of claim 1 in which the leg portion of the spring means is bowed toward the stop member to provide a firm gripping action for the second jamb member.

5. The frame member of claim 1 in which the first transverse arm of the spring means is shorter than the thickness of the jamb and the second transverse arm is longer than the jamb thickness.

6. An adjustable width frame member for wall openings which comprises:

(a) first and second jamb members, each member having front and rear surfaces and inner and outer edges;

(b) a stop member; and (c) a generally F-shaped spring means having an elongated leg portion and two transverse arms, the stop member being permanently united to the front surface of the first jamb member so as to overhang the inner edge and form one side of a slot,.

the spring means being anchored by its transverse arms onto the rear surface of the first jamb member, the leg portion of the spring means being oriented generally parallel to the overhanging stop member to form the other side of the slot, the inner edge of the second jamb member being disposed in the slot so as to be slideable toward or away from the first jamb member and being gripped against the stop by the leg portion of the spring means so as to form a frame adaptable for installation on walls of varying thickness.

7. The frame member of claim 6 in which the transverse arms are anchored into the rear surface of the front jamb member.

8. The frame member of claim 6 in which the rear surfaces of the jamb members are inlet in the area of the F-shaped spring means so that the spring means is flush with said rear surfaces.

* * * * *